US008128425B2

(12) United States Patent
Takahashi et al.

(10) Patent No.: US 8,128,425 B2
(45) Date of Patent: Mar. 6, 2012

(54) CABLE CONNECTOR HAVING MULTIPLE, MUTUALLY INDEPENDENT CONTACT ARMS

(75) Inventors: Kazuya Takahashi, Zama (JP); Yoko Sugii, Yamato (JP); Hideyuki Hirata, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/810,863

(22) PCT Filed: Dec. 23, 2008

(86) PCT No.: PCT/US2008/014040

§ 371 (c)(1),
(2), (4) Date: Oct. 4, 2010

(87) PCT Pub. No.: WO2009/082490

PCT Pub. Date: Jul. 2, 2009

(65) Prior Publication Data

US 2011/0117765 A1 May 19, 2011

(30) Foreign Application Priority Data

Dec. 26, 2007 (JP) ..... 2007-334893

(51) Int. Cl.
*H01R 13/15* (2006.01)
*H01R 13/62* (2006.01)

(52) U.S. Cl. ..... 439/260

(58) Field of Classification Search ..... 439/494, 439/495, 492, 499, 260, 326–329
See application file for complete search history.

(56) References Cited

U.S. PATENT DOCUMENTS

| | | | | |
|---|---|---|---|---|
| 6,755,682 | B2 * | 6/2004 | Kunishi et al. | 439/495 |
| 7,137,838 | B2 * | 11/2006 | Koga | 439/260 |
| 7,275,954 | B2 * | 10/2007 | Ikenaga et al. | 439/494 |
| 7,306,478 | B2 * | 12/2007 | Kudo et al. | 439/494 |
| 7,621,768 | B2 * | 11/2009 | Suzuki et al. | 439/260 |
| 7,828,570 | B2 * | 11/2010 | Suzuki et al. | 439/260 |
| 2004/0002254 | A1 * | 1/2004 | Tsunematsu | 439/495 |

FOREIGN PATENT DOCUMENTS

EP 1 378 966 A1 1/2004

OTHER PUBLICATIONS

International Search Report for PCT/US2008/0014040.

* cited by examiner

*Primary Examiner* — Chandrika Prasad
(74) *Attorney, Agent, or Firm* — Timothy M. Morella

(57) ABSTRACT

A cable connector is provided including an insulative housing having an insertion opening through which a flat flexible cable may be inserted. An actuator is movably mounted on the housing and configured to be moved from a first position at which the flat flexible cable may be inserted and a second position at which the contact pads of the flat flexible cable are operatively engaged by terminals of the connector. A plurality of conductive terminals are mounted in the housing. Each terminal is configured to be electrically connected to a contact pad of the flat flexible cable. Each terminal includes a base portion disposed at a rear end of the terminal and extending in the vertical direction, an actuator holding arm portion, a front resilient contact arm portion, and a rear resilient contact arm portion. The contact arm portions engage the contact pads in a mutually independent way. The actuator holding arm portion and each contact arm portion have a proximal end thereof secured to the base portion and a contact portion at a free end of thereof.

8 Claims, 10 Drawing Sheets

CABLE CONNECTOR HAVING MULTIPLE, MUTUALLY INDEPENDENT CONTACT ARMS

BACKGROUND OF THE INVENTION

The present invention generally relates to a cable connector and more specifically to a cable connector having a terminal with improved reliability.

Flexible flat cables such as flexible printed circuits (FPC), flat flexible cables (FFC) or the like are typically connected to circuit boards by using cable connectors, such as FPC connectors or FFC connectors. (Refer, for example, to Japanese Patent Application Laid-Open (Kokai) Publication No. 2000-106238).

As shown in the FIG. 10, the cable connector has a housing 811 formed of an insulating material such as a synthetic resin and a plurality of terminals 851 formed of a conductive material such as metal and held in the housing 811. On the upper surface of the housing 811, an actuator 821 formed of an insulating material such as a synthetic resin is disposed. The actuator 821 is pivotably attached to the housing 811 and configured to be rotated between an open position shown in the drawing and a closed position (not shown).

Each terminal 851 has a contact portion 852 that is opposed to one surface (the lower surface in FIG. 10) of a flat flexible cable 901 and a pivot shoulder portion 853 having a concave portion 854 that is opposed to the other surface (the upper surface in FIG. 10) of the flat flexible cable 901.

Actuator 821 includes a recess 823 and a shaft portion 822 formed at a position corresponding to the pivot shoulder portion 853 of each terminal 851. The pivot shoulder portion 853 is inserted into recess 823 to mount the actuator 821 on the cable connector so that the shaft portion 822 thereof is accommodated in the concave portion 854. As a result, the actuator 821 can be pivotally rotated relative to the housing 811 about the shaft portion 822.

As shown in FIG. 10, the flat flexible cable 901 is inserted into the housing 811 through an opening 812 therein with the actuator 821 at the open position thereof. Once the flat flexible cable 901 has been fully inserted into the opening 812, the actuator 821 is rotated by an operator's finger or the like to the closed position thereof. As a result, the flat flexible cable 901 is pressed downward by the actuator 821, and contact pads (not shown) on the lower surface of the flat flexible cable 901 are brought into electrical contact with a contact portion 852 of each terminal 851.

However, in the conventional cable connector, when the flat flexible cable 901 is connected, foreign material adhering to the flat flexible cable 901 might enter the opening portion 812 of the housing 811 and become engaged between a contact pad on the lower surface of the flat flexible cable 901 and the contact portion 852 of the terminal 851. In such a situation, the contact pad will fail to be electrically connected to the contact portion 852 of terminal 851.

Some connectors have used a pair of contact portions so that electrical connection may continue even when foreign material becomes lodged between one of the contact portions and the contact pad of the flat flexible cable 901. However, if 15. the foreign material is large in size, one of the contact portions may be displaced away from the contact pad so far that the other contact portion is also displaced away from the contact pad. This results in either poor or no electrical contact between the terminal and the contact pad.

SUMMARY OF THE INVENTION

It is an object to solve the above-described problems encountered by the conventional cable connector and to provide a cable connector which is small in its size and high its durability in which each terminal includes a plurality of contact arm portions which can be elastically displaced in a mutually independent manner. Each of the contact portions of the respective contact arms may be arranged in an insertion/removal direction of a flat flexible cable be disposed within a range in which they are opposed to a cable pressing surface of an actuator. This configuration permits contact pads of the flat flexible cable to be securely electrically connected to the contact portions of the contact arms even in the presence of foreign material, to maintain the position of the actuator and ensure that the flat flexible cable may be securely connected thereto.

For this reason, the cable connector according to the disclosed embodiment includes a housing having an insertion opening through which a flat flexible cable is inserted; a plurality of terminals mounted in the housing and being capable of electrical connection to contact pads of the flat flexible cable. An actuator is movable between a first position where the flat flexible cable can be inserted and a second position where the contact pads of the flat flexible cable are connected to the terminals. Each of the terminals includes an actuator holding arm portion that is engaged with a shaft portion of the actuator and a plurality of contact arm portions that are configured to be opposed to the actuator holding arm portion and to be electrically connected to the contact pads. The actuator includes a pressing portion that is pivotally rotatable together with the shaft portion and presses the flat flexible cable against the contact arm portions. The contact arm portions are mutually independent members, with each having a proximal end thereof held by a base portion of the terminal and a contact portion which is formed at a free end thereof to be capable of coming into contact with the contact pad. The respective contact portions are disposed at mutually different positions with respect to an insertion/removal direction of the flat flexible cable.

In the cable connector according to another embodiment, the center of a pivotal rotation of the shaft portion is disposed between the contact portions along the insertion direction of the flat flexible cable. In the cable connector according to a further embodiment, an upper end of the contact portion located closest to the insertion side of the flat flexible cable is disposed at a position lower than an upper end of the contact portion located further from the insertion side. In the cable connector according to a still further embodiment, the cable pressing surface of the pressing portion is inclined downward toward the front side when the actuator is at the second position. In the cable connector according to a still further embodiment, the respective contact portions have a sloped surface formed at the front side thereof and inclined downward toward the front side.

The cable connector is provided with terminals, each including a plurality of contact arm portions which can be elastically displaced in a mutually independent manner. Contact portions of the respective contact arm portions are arranged one after another in an insertion/removal direction of a flat flexible cable and are disposed within the range where they are configured to be opposed to a cable pressing surface of an actuator. With this arrangement, contact pads of the flat flexible cable secure electrical connection between the contact pads and the terminals of the cable connector can be maintained even in the presence of foreign material.

In another aspect of the disclosed embodiment, a cable connector is provided including an insulative housing having an insertion opening through which a flat flexible cable may be inserted. An actuator is movably mounted on the housing and configured to be moved from a first position at which the flat flexible cable may be inserted and a second position at which the contact pads of the flat flexible cable are operatively engaged by terminals of the connector. A plurality of conductive terminals are mounted in the housing. Each terminal is configured to be electrically connected to a contact pad of the flat flexible cable. A first group of the terminals has an actuator holding arm portion that engages the actuator to facilitate movement of the actuator between the first and second positions. Each of a second group of the terminals has a plurality of distinct, resilient, cantilevered, contact arm portions configured to be electrically connected to one of the contact pads of the flat flexible cable.

If desired, the actuator may be rotatably mounted on the housing for rotational movement between the first and second positions and the actuator holding arm portions of the first group of terminals may engage a shaft portion of the actuator to facilitate the rotation of the actuator. If desired, the contact arm portions may be mutually independent members with each having a proximal end thereof secured to a base portion of the terminal and a contact portion at a free end of thereof configured to engage the contact pads of the flat flexible cable. If desired, the contact portions of each terminal may be disposed at mutually different positions with respect to an insertion direction of the flat flexible cable. If desired, the actuator may include a cable pressing surface that is opposed to the contact arm portions when the actuator is in the second position. If desired,

DESCRIPTION OF THE PREFERRED EMBODIMENTS

Figure 1:
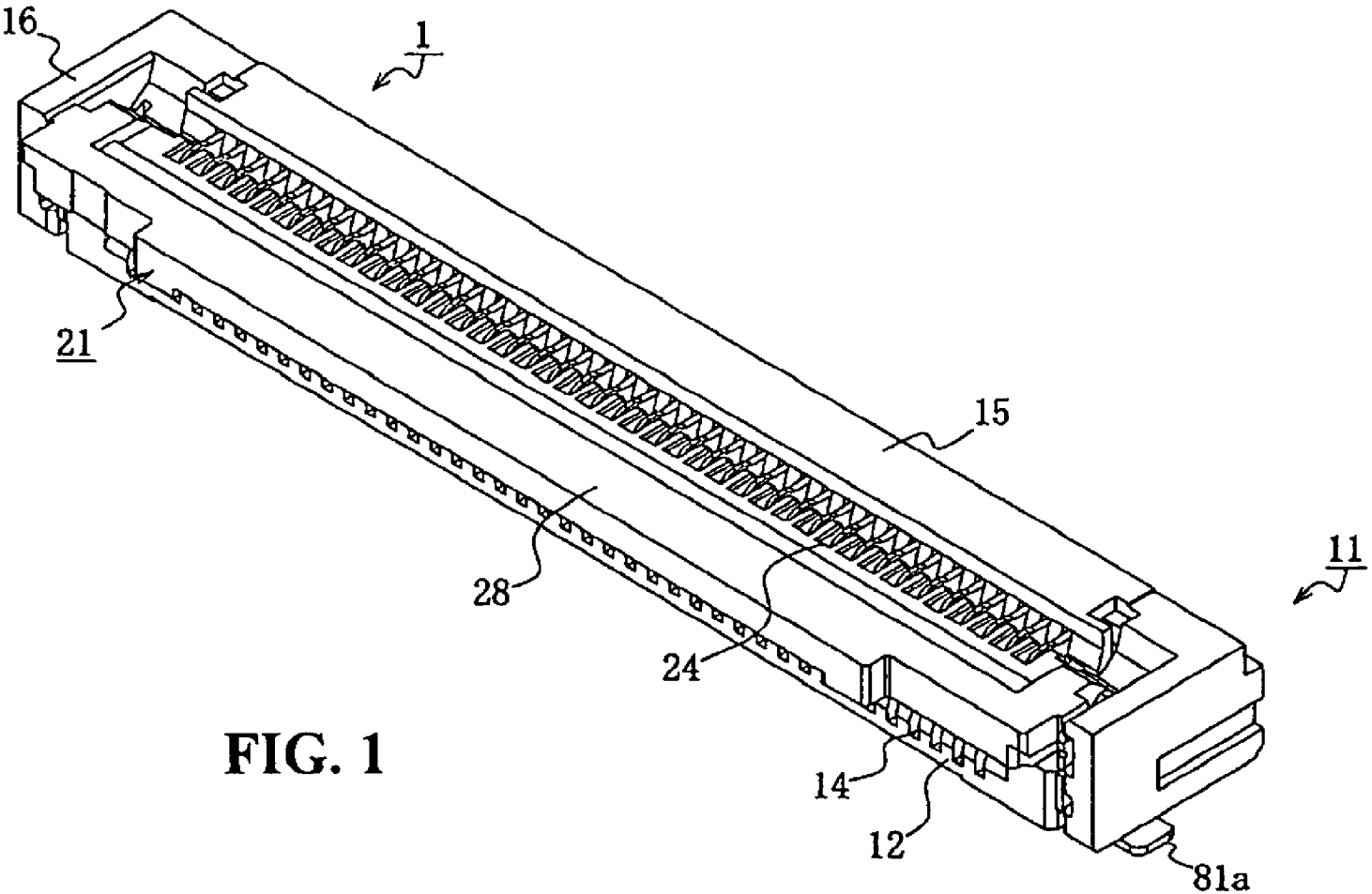
FIG. 1 is a perspective view of a cable connector according to an embodiment of the present invention, illustrating a state in which the actuator is at its closed position.

Preferred embodiments are described in detail below with reference to the accompanying drawings in which like reference numerals designate corresponding components throughout the drawings.

Referring to FIGS. 1-5, a cable connector is configured to be mounted on a surface of a circuit member (not shown) such as a circuit board and is used to electrically connect a flat flexible cable 101 to the circuit member. The lower surface of connector 1 confronts the board mounting surface of the circuit member. The flat flexible cable 101 is a flexible flat cable such as an FPC, FFC, or the like, and may be any type of flat cable as long as it has parallel, spaced apart contact pads 151. In this embodiment, representations of directions such as up, down, left, right, front, rear, and the like, used for explaining the structure and movement of each part of the connector 1 are not absolute, but relative. These representations are appropriate when the connector 1 is in the position shown in the drawing figures. If the position of the connector 1 changes, however, it is assumed that these representations are to be changed according to the change of the position of the connector 1, and the like.

Connector 1 has an elongated flat housing 11 integrally formed of an insulating material such as a synthetic resin and an elongated, thin actuator 21 integrally formed of an insulating material such as a synthetic resin is rotatably mounted on the housing 11. Actuator 21 is mounted on the housing 11 so as to be pivotally rotatable between a first, open position and a second, closed position.

The housing 11 has a lower portion 12, a upper portion 15, left and right side portions 16, and an insertion opening 33 formed between the lower portion 12, the upper portion 15, and the side portions 16, and into and from which an end portion of the flat flexible cable 101 may be inserted and removed. In this embodiment, the entrance side (in FIGS. 3 and 4, the left lower side) of the insertion opening 33 is referred to as the front side of the connector 1 and the side opposite of the insertion opening 33 (in FIGS. 3 and 4, the right upper side) is referred to as the rear side of the connector 1.

Housing 11 includes a plurality of terminal receiving grooves or cavities 14 into which metallic terminals 51 are inserted. In the depicted embodiment, the number of the terminal receiving grooves 14 is forty, with a pitch or spacing of about 0.5 mm, and each terminal 51 is inserted into one of the terminal receiving grooves 14. It should be noted that a terminal 51 does not need to be inserted into each of the terminal receiving grooves 14; some of the terminals 51 may be omitted as necessary according to an arrangement of the contact pads 151 of the flat flexible cable 101.

Figure 5:
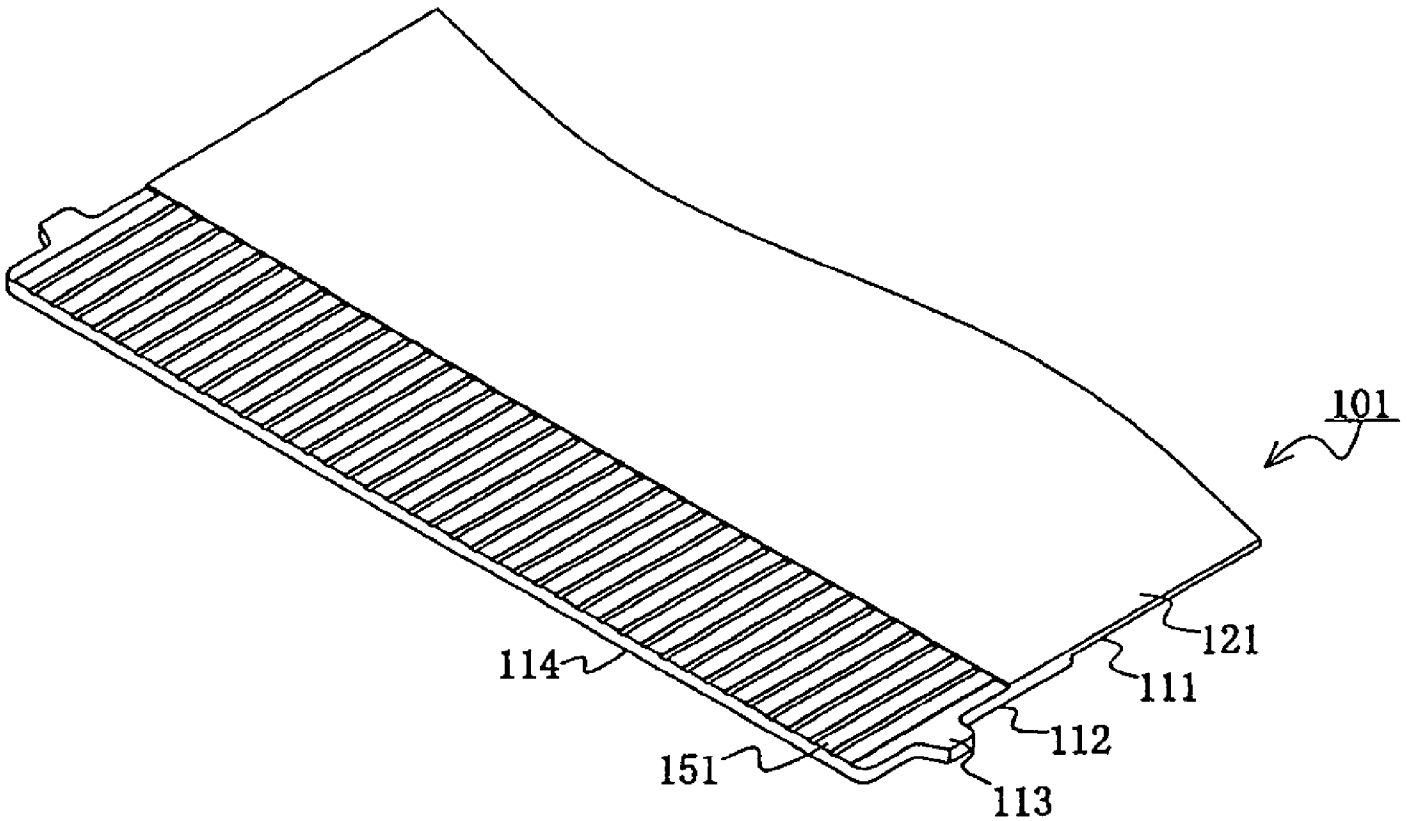
FIG. 5 is a perspective view illustrating the lower surface of the flat flexible cable used with the connector of FIG. 1.

Referring to FIG. 5, the flat flexible cable 101 has a base plate portion 111 that is an insulating thin-sheet member having a long and thin strip-like shape and a plurality of, for example, forty, conductive contact pads 151 disposed on one surface of the base plate portion 111. In FIG. 5, only those portions of cable 101 adjacent front end portion 114 of the flat flexible cable 101 are shown. The contact pads 151 are foil-like rectangular areas made of conductive metal such as copper and are disposed to be in parallel with one another at a predetermined pitch of 0.5 mm or so, for example. The number and the pitch of the contact pads 151 can be appropriately changed, if desired, so long as the pitch corresponds to that of the conductive terminals 51 within housing 11.

The contact pads are connected to individual leads or wires (not shown) that are covered by an insulating layer 121. The insulating layer 121 is not formed at a portion of the flat flexible cable 101 within a predetermined distance from the front end portion 114 so that the upper surfaces of the contact pads 151 are exposed. On a portion of the flat flexible cable 101 within a predetermined length from the front end portion 114, an auxiliary plate 112 is bonded at a side opposite to the side on which the contact pads 151 are exposed. The auxiliary plate 112 is formed of a material having relatively high hardness such as polyimide and covers the entire width of a portion of the surface of the flat flexible cable 101 opposite to the side on which the contact pads 151 are exposed. It is preferred that the exposed length of the contact pads 151 is within the length in which the auxiliary plate 112 is bonded.

At both ends in the width direction of the length in which the auxiliary plate 112 is bonded, ear or tab portions 113 are formed to project outward.

In the side portions 16 of the housing 11, slit-shaped auxiliary bracket accommodating recesses 16*b* are arranged in the insertion/removal direction of the flat flexible cable 101. Connector attachment auxiliary brackets 81, which are commonly called fitting or solder nails, are inserted into the auxiliary bracket accommodating recesses 16*b* and attached to the housing 11. The connector attachment auxiliary brackets 81 function as connecting brackets in which the bottom surfaces of connecting portions 81*a* that project outward from the lower ends thereof are connected to the surface of the board by fixing means such as soldering to attach the housing 11 to the board.

Figure 2:
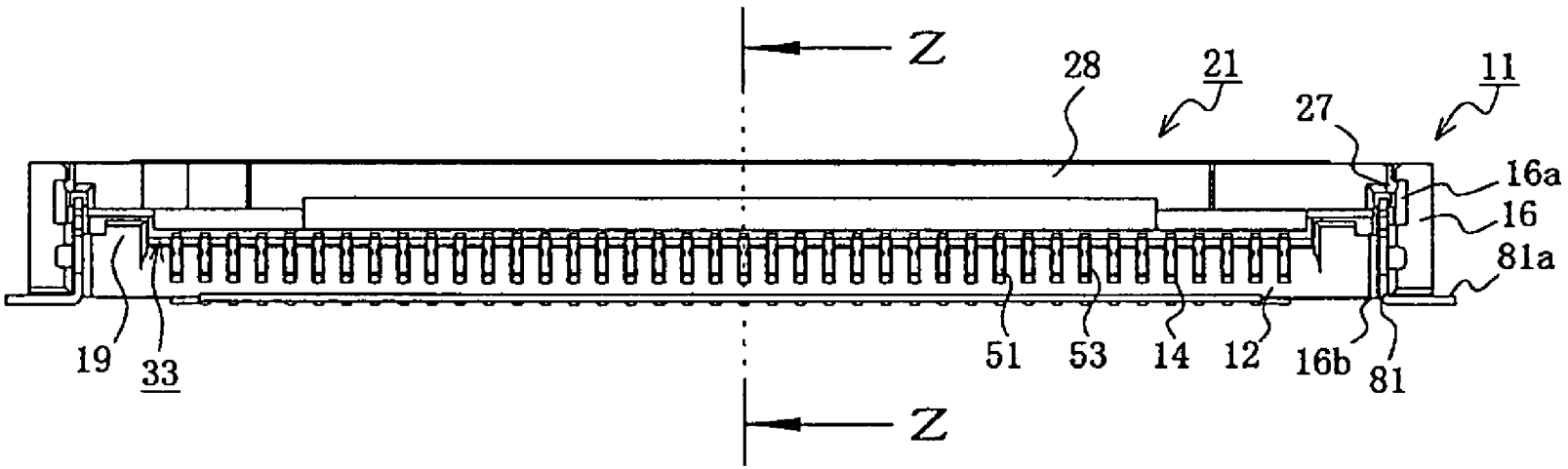
FIG. 2 is a front end view of the cable connector of FIG. 1.

As shown in FIGS. 1 and 2, engaging recesses 16*a* are positioned at inner surfaces of the side portions 16 to engage locking portions or projections 27 of the actuator 21 when the actuator 21 is positioned at the closed position. Further, at portions of the upper surface of the lower portion 12 adjacent to the side portions 16, cable engaging portions 19 are formed so as to project upwardly. Cable engaging recesses 19*a* are formed behind cable engaging portions 19 when viewed in the cable insertion direction (up and to the right, as viewed in FIG. 3). Such cable engaging recesses 19*a* receive and retain the ear portions 113 of the flat flexible cable 101 when the cable is properly and fully inserted into connector 1. With this arrangement, ear portions 113 will engage cable engaging portions 19 if the cable is attempted to be pulled from the connector 1 with actuator 21 in its closed position.

The actuator 21 has an actuator body 22, which is a substantially rectangular, thick plate-like member, locking portions or projections 27 formed to project outward from both ends of the actuator body 22, a pressing portion 23 formed at the lower surface of the actuator body 22, and an operating portion 28 that extends from the leading edge of the actuator body 22 but does not extend the full width of the actuator.

The pressing portion 23 is configured to press a flat flexible cable 101 inserted through the insertion opening 33 downward, i.e., toward the lower portion 12, when the actuator 21 is at the closed position. The lower surface of the pressing o portion 23, when the actuator 21 is at the closed position, is a cable pressing surface 23*a* which contacts the upper surface of a flat flexible cable 101 inserted through the insertion opening 33, i.e., it engages the surface opposite to the side the contact pads 151.

A plurality of accommodating grooves 24 are formed at portions of the pressing portion 23 at the opposite side of the operating portion 28 for accommodating upper shoulder beams 55 (described below) of the terminals 51. With such an arrangement, the pressing surface 23*a* forms a single, continuous flat surface at portions where the accommodating grooves 24 are not formed. However, at locations where the accommodating grooves 24 are formed, the pressing surface 23*a* is divided into plural parts by the accommodating grooves 24, forming a comb-like shape in which a plurality of narrow and long partition walls 23*b* are arranged along the length of the actuator 21. The position of the accommodating grooves 24 correspond to those of the terminal receiving grooves 14.

Actuator 21 has a shaft portion 48 at the rear portion of the actuator body 22 when the actuator 21 is at its closed position. The shaft portion 48 extends along the entire length and passes through the accommodating grooves 24 to connect the partition walls 23*b* to each other. The portions of the shaft portion 48 disposed within the accommodating grooves 24 engage the upper shoulder beams 55 of the terminals 51. At both side surfaces of the actuator body 22, lateral shaft portions 49 are integrally formed so as to laterally outwardly project. The lateral shaft portions 49 are restricted from moving in the forward and downward directions by the connector attachment auxiliary brackets 81 accommodated in the auxiliary bracket accommodating concave portions 16*b* of the housing 11. Specifically, the lateral shaft portions 49 are restricted from the forward movement by the connector attachment auxiliary brackets 81 and are supported from the bottom side.

The connector 1 is mounted on a surface of a circuit member (not shown) having a connector mounting surface. The circuit member may be a printed circuit lo board, for example, and may be any member as long as it can mount the connector 1 thereon. In addition, the connector 1 is used as a so-called right-angle type connector and is mounted in a state so that the lower surface (the lower surface in FIG. 2) of the housing 11 is opposed to the surface of the board and the insertion openings 33 are arranged in parallel to the board.

The connector attachment auxiliary brackets 81 are configured to be connected to the board by soldering so that the bottom surfaces of the connecting portions 81*a* that project outward are opposed to the surface of an attachment pad of the board. Further, the terminals 51 are connected to the board by soldering in a configuration in which the bottom surface of tail portions 58 (described below) of the terminals 51 are opposed to the surface of the solder pads of the board. With this arrangement, the housing 11 is fixed on the surface of the board, and the respective terminals 51 are electrically connected to corresponding conductive traces, thereby completing an electrical connection between the terminals 51 and the traces on the circuit member.

Referring to FIGS. 6-9, the terminals 51 are formed by punching or blanking sheet metal into a uniform shape and are arranged within the housing 11 in a uniform array along the length (left-right direction in FIG. 2) of the housing 11. Each terminal 51 has a base portion 56 disposed at the rear end thereof and extending in the vertical direction, an upper shoulder beam 55 functioning as the actuator holding arm portion extending from the upper end of the base portion 56 toward the front side (in FIGS. 6 to 8, the left side), a tail portion 58 functioning as the board connecting portion extending from the lower end of the base portion 56 toward the lower side, and an auxiliary block portion 57 extending from the lower end of the base portion 56 toward the front side.

Further, each terminal 51 has a front resilient contact beam 53, which extends from a lower end of the base portion 56 and functions as a first contact arm portion extending from a portion immediately above the auxiliary block portion 57 2.0 toward the front side, and a rear resilient contact beam 54, which extends from an intermediate portion of the base portion 56 and functions as a second contact arm portion extending from a portion between the upper shoulder beam 55 and the front contact beam 53 toward the front side. The front contact beam 53 and the rear contact beam 54 are disposed so as to be opposed to the upper shoulder beam 55. A front contact portion 53*a* for contacting the contact pads 151 of the flat flexible cable 101 is formed at a free end, i.e., the front end of the front contact beam 53. Meanwhile, a rear contact portion 54*a* for contacting the contact pads 151 of the flat flexible cable 101 is formed at a free end, i.e., the front end of the rear contact beam 54. In addition, a front terminal sloped surface 53*b*, which is inclined downward toward the front side is formed at the front portion of the front contact portion 53*a* of the front contact beam 53. The front portion of the rear contact portion 54*a* of the rear contact beam 54 also has a rear terminal sloped surface 54*b* which is inclined downward toward the front side.

Figure 6:
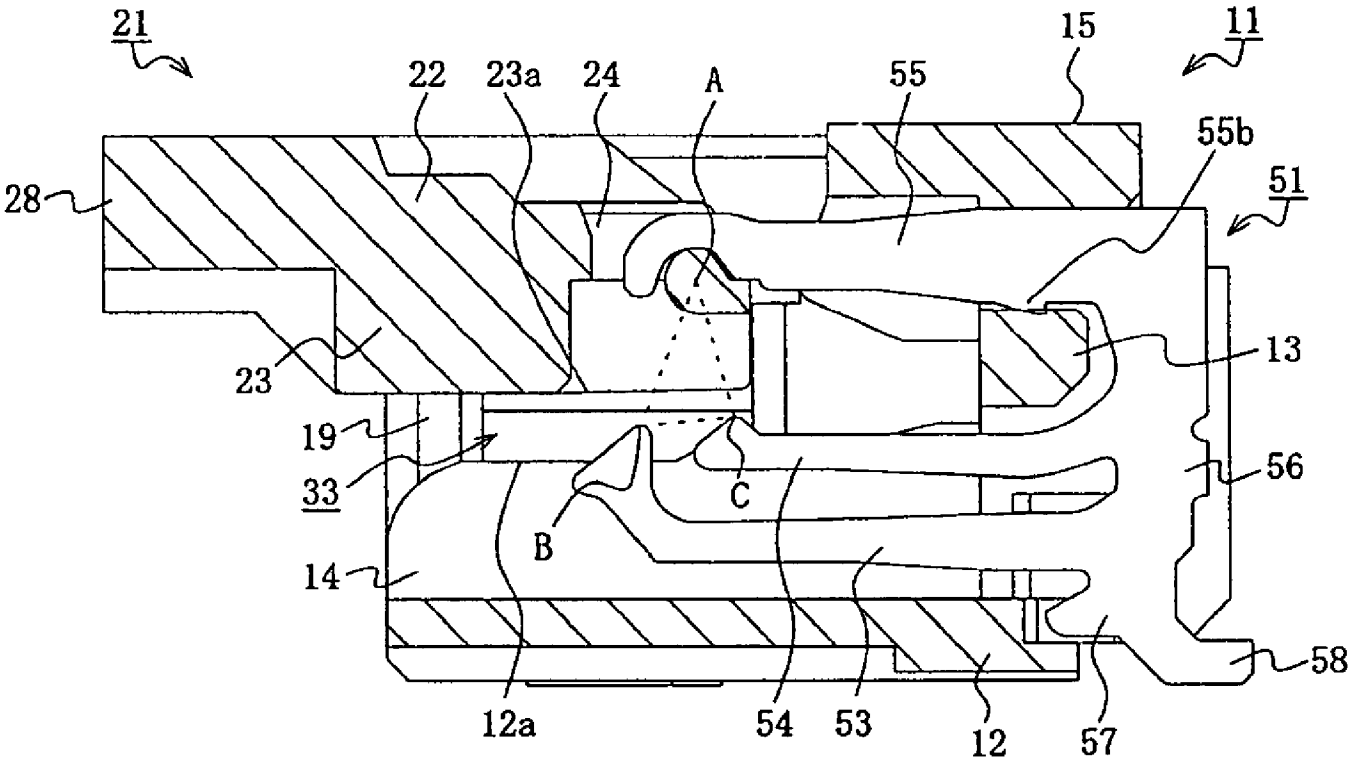
FIG. 6 is a cross-sectional view taken generally along line Z-Z of FIG. 2, illustrating the internal structure of the cable connector of FIG. 1 when the actuator is at the closed position.
Figure 7:
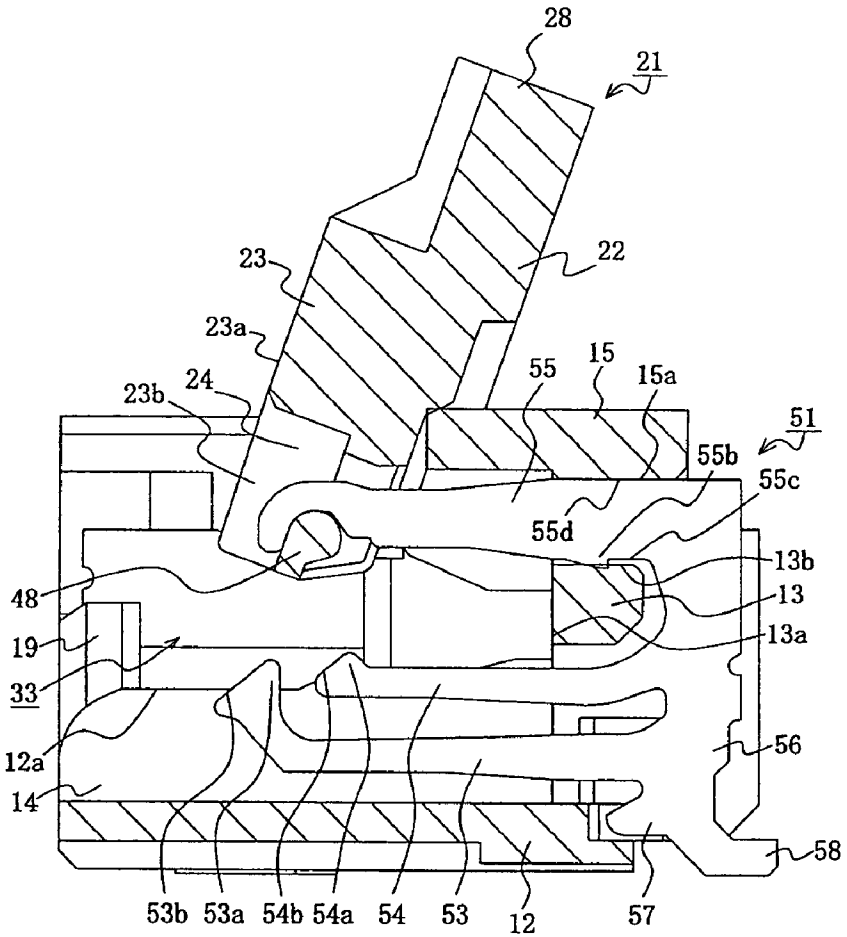
FIG. 7 is a cross-sectional view similar to that of FIG. 6 but with the actuator at its open position.
Figure 8:
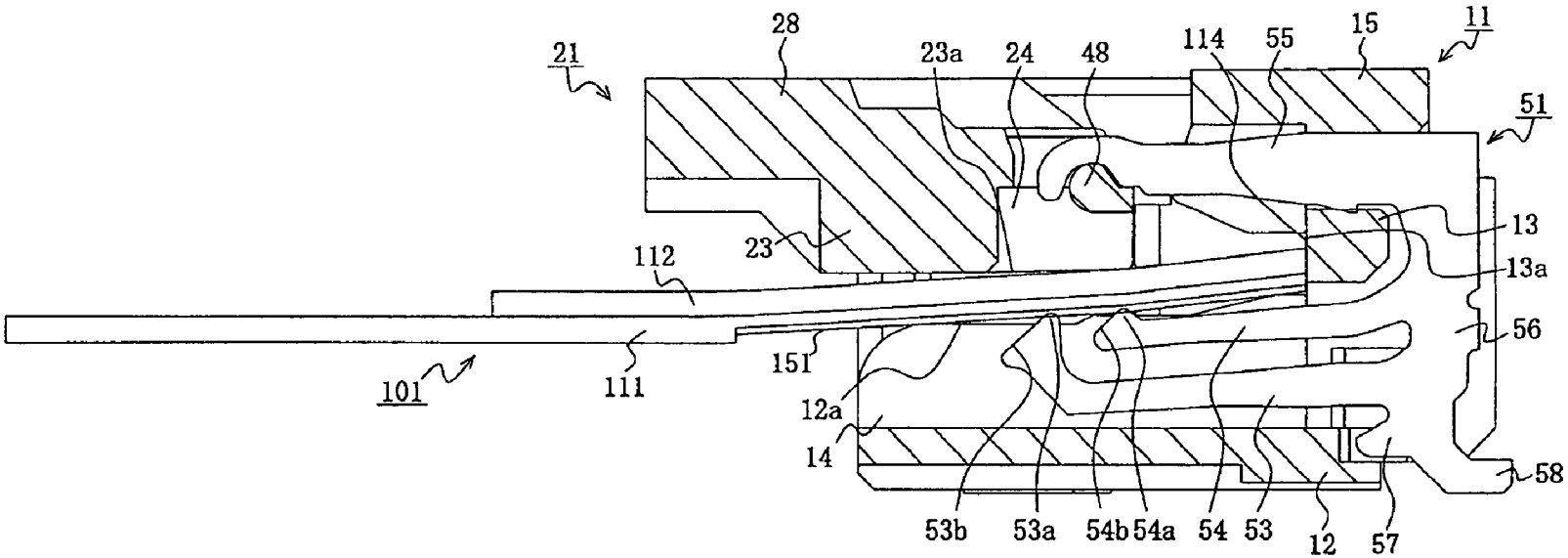
FIG. 8 is a cross-sectional view similar to that of FIG. 6 but with the flat flexible cable inserted into the cable connector.
Figure 9:
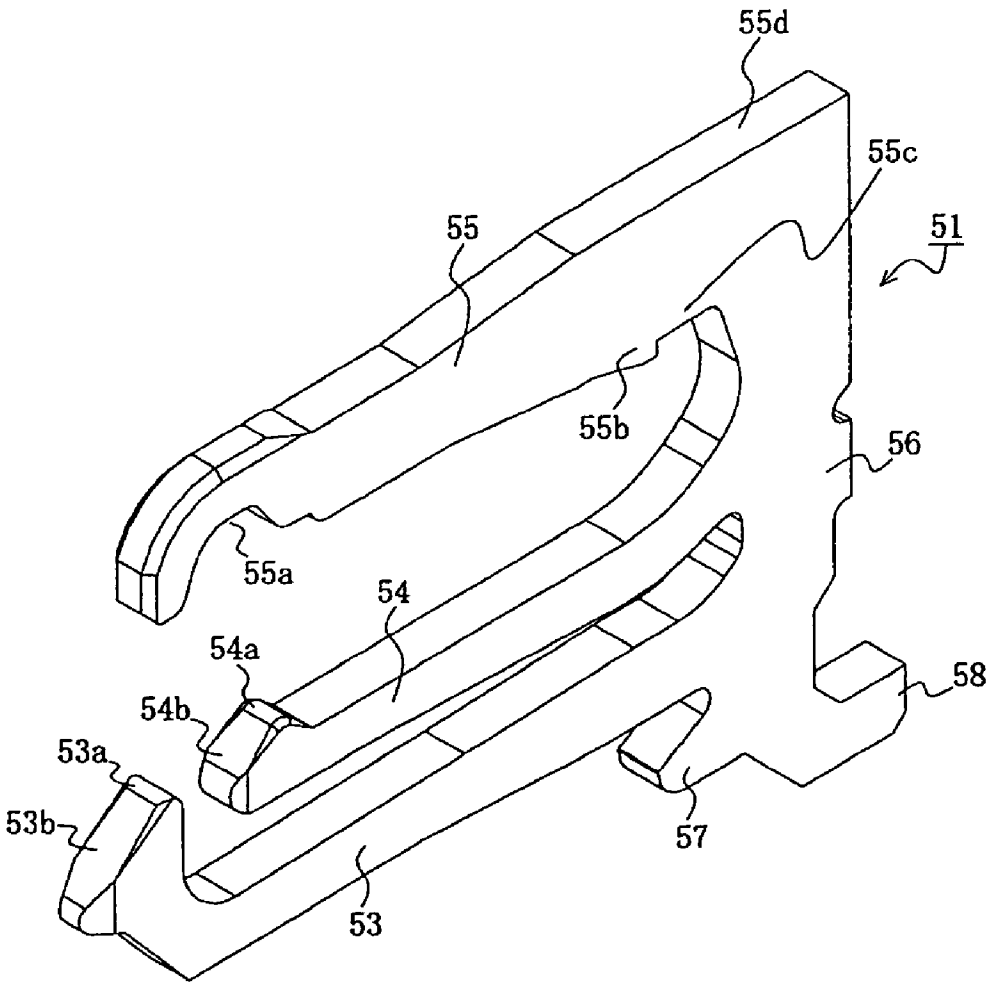
FIG. 9 is a perspective view of a terminal according to the embodiment of the present invention.
Figure 10:
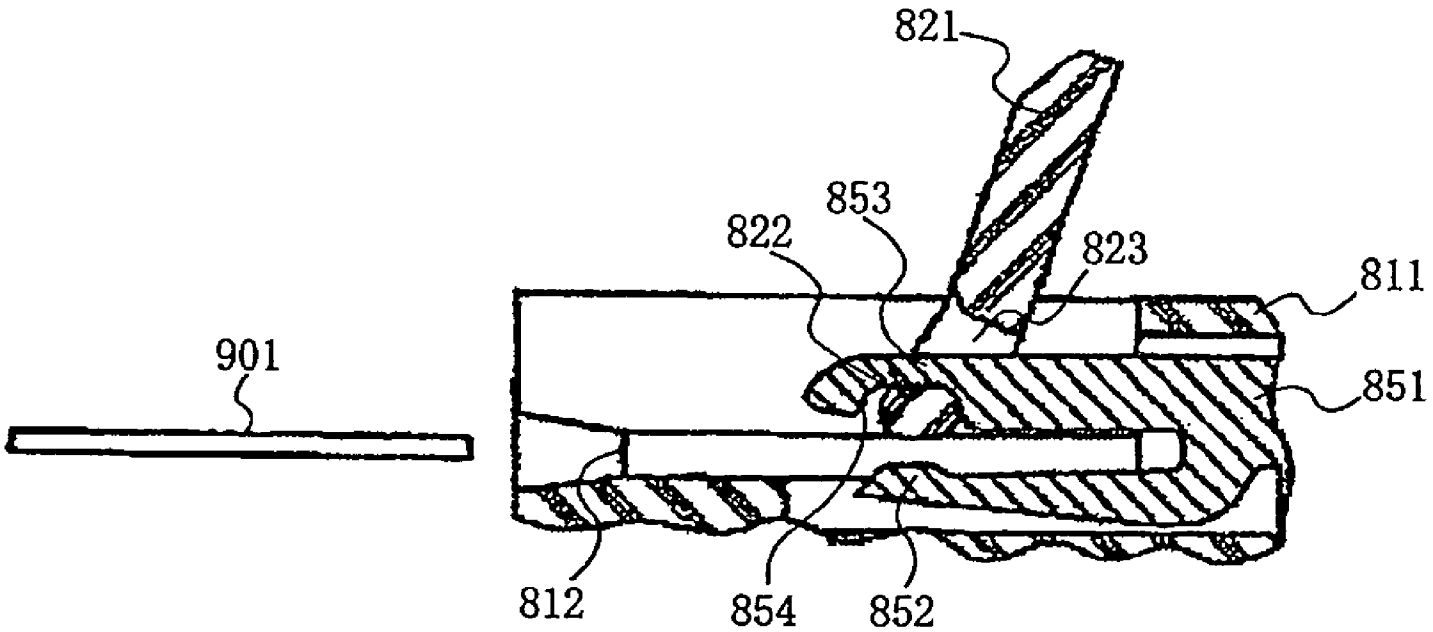
Prior art FIG. 10
FIG. 10 is a perspective view of a prior art cable connector.

As shown in FIGS. 6 to 8, vertical movement of the front contact beam 53 and the rear contact beam 54 is not restricted within the housing 11 and they can be displaced independently in the up-down direction. For this reason, the front contact beam 53 and the rear contact beam 54 function as independent cantilevered spring members in which a proximal end, (i.e., the rear end) is fixed to the base portion 56 and the front end is a free end. In addition, the front contact beam 53 and the rear contact beam 54 are not interconnected, but rather both extend from the base portion 56.

With this arrangement, the front contact portion 53*a* and the rear contact portion 54*a* can be displaced vertically in a mutually independent manner through the functioning of the front contact beam 53 and the rear contact beam 54 as spring members. Therefore, the front contact portion 53*a* and the rear contact portion 54*a* each engage the same contact pad 151 of the flat flexible cable 101 but in mutually independent manners. Through such a configuration, it is possible to maintain secure contact between the front and rear contact portions and the contact pads 151.

During operation, the flat flexible cable 101 is disposed between the pressing portion 23 of the actuator 21 and the front contact portion 53*a* and the rear contact portion 54*a* by the downward force applied by the pressing portion 23 of the actuator 21 and the upward force applied by the front contact portion 53*a* and the rear contact portion 54*a*.

The housing 11 has a terminal supporting portion 13 disposed within the terminal receiving groove 14 between the lower portion 12 and the upper portion 15 of the housing. The terminal supporting portion 13 is disposed adjacent the rear end of the terminal receiving groove 14. A front end surface 13*a* of the terminal 2 0 supporting portion 13 contacts the front end portion 114 of the flat flexible cable 101 when the cable 101 is inserted through the insertion opening 33 so that the position of the flat flexible cable 101 is set with respect to the front-rear direction of the housing 11.

When the terminal 51 is pushed into the terminal receiving groove 14 from the rear side of the housing 11, a press-fit projection 55*b* that projects downward from a lower end portion 55*c* of the upper shoulder beam 55 of the terminal 51 engages or skives into an upper surface 13*b* of the terminal supporting portion 13. In addition, a portion adjacent the press-fit projection 55*b* of the lower end portion 55*c* of the upper shoulder beam 55 and an upper end portion 55*d* are respectively pressed against the upper surface 13*b* of the terminal supporting portion 13 and the lower surface 15*a* of the upper portion 15. That is, the press-fit projection 55*b* of the upper shoulder beam 55 is brought into engagement with the upper surface 13*b* of the terminal supporting portion 13, and the upper shoulder beam 55 is secured from above and below by the terminal supporting portion 13 and the upper portion 15, whereby the terminal 51 is securely received and held in the terminal receiving groove 14 of the housing 11.

In the vicinity of the front end of the upper shoulder beam 55, a curved shaft lo engaging portion 55*a* is recessed upward and engages the shaft portion 48 of the actuator 21. The portion of the shaft portion 48 disposed within the accommodating groove 24 is pivotally rotatably accommodated within the shaft engaging portion 55*a* and is rotated within the shaft engaging concave portion 55*a* in accordance with the change of position of the actuator 21 between the closed position and the open position, as shown in FIGS. 6 to 8.

As shown in FIG. 6, assuming that the center of rotation of the shaft portion 48 is around point "A," the upper end of the front contact portion 53*a* is "B," and the upper end of the rear contact portion 54*a* is "C," an imaginary, acute triangle "ABC" with vertices at "A," "B," and "C" is formed; that is, all of the vertex angles are less than 90 degrees. It can be seen that the center of rotation "A" of the shaft portion 48 is located between the upper end "B" of the front contact portion 53*a* and the upper end "C" of the rear contact portion 54*a* with respect to the front-rear direction of the housing 11, i.e., relative to the insertion/removal direction of the flat flexible cable 101.

With this arrangement, when the pressing portion 23 of the actuator 21 is in the closed position, upward pressing forces are applied by the spring forces of both of the front contact beam 53 and the rear contact beam 54 via the front contact portion 53*a* and the rear contact portion 54*a*. As a result, a rotational moment resulting from the upward pressing force is not applied toward the center of rotation of the shaft portion 48, but rather applied on opposite sides thereof. These rotational moments tend to cancel each other and actuator 21 is inclined to stay at the closed position even if an unpredicted external force such as a shock or vibration is applied. In other words, since the two contact points "B" and "C" are on opposite sides of the center of rotation "A," the actuator will tend to remain in the closed position once the flat flexible cable is inserted and the actuator 21 closed, even if external forces are applied.

The side "BC" of the triangle "ABC" is disposed at a position opposite the to pressing surface 23*a* of the pressing portion 23 of the actuator 21 when it is at the closed position with respect to the insertion/removal direction of the flat flexible cable 101. In other words, the upper end of the front contact portion 53*a* and the upper end of the rear contact portion 54*a* are disposed within the range of the pressing surface 23*a* of the pressing portion 23 of the actuator 21 when it is at the closed position with respect to the insertion/removal direction of the flat flexible cable 101. With this arrangement, the flat flexible cable 101 is secured from above and below by the pressing surface 23*a* of the pressing portion 23 and the front contact portion 53*a* and the rear contact portion 54*a* to positively retain the cable 101 within the connector 1.

In addition, it should be noted that the side "BC" of the triangle "ABC" is inclined slightly downward toward the front insertion side with respect to the mounting surface of the connector 1. In other words, the upper end "B" of the front contact portion 53*a* is disposed at a position lower than the upper end "C" of the rear contact portion 54*a;* that is, the upper end of the front contact portion 53*a* is disposed closer to the board. As configured in the current embodiment, the sloped angle of the side "BC" is four degrees, for example, but may be changed as desired.

The pressing surface 23*a* of the pressing portion 23 of the actuator 21 is almost parallel to the side "BC" when actuator 21 is closed and the pressing surface 23*a* secures the flat flexible cable 101 in cooperation with the front contact portion 53*a* and the rear contact portion 54*a*. Thus, similar to the side "BC," the pressing surface 23*a* is also inclined downward toward the front side. Therefore, the actuator 21 including the pressing portion 23 is inclined downward toward the front side to assist in holding the actuator 21 in the closed position.

Since the upper end "B" of the front contact portion 53*a* is disposed at a position lower than the upper end "C" of the rear contact portion 54*a,* the front contact portion 53*a* projects above the upper surface 12*a* of the lower portion 12 a smaller amount than the rear contact portion 54*a*. When inserted through the insertion opening 33, the flat flexible cable 101 is first moved along the upper surface 12*a* of the lower portion 12 and subsequently slides up the front contact portion 53*a* and then the rear contact portion 54*a*. Therefore, the flat flexible cable 101 is inclined upward toward the front side such that the front end portion 114 is directed obliquely upward as best shown in FIG. 8. For this reason, when the front contact portion 53*a* only projects slightly above the upper surface 12*a* of the lower portion 12, the front end portion 114 of flat flexible cable 101 smoothly slides over front contact portion 53*a* and, therefore, the flat flexible cable 101 may be smoothly inserted into the insertion opening 33.

Tail portion 58 projects rearward from the rear end of the bottom surface of the housing 11 and is exposed to the outside thereof. The tail portion 58 is configured to be soldered to a solder pad on the surface of the board when the lower surface of the tail portion is opposed to the solder pad. With this arrangement, the terminals 51 are electrically connected to a conductive trace of the board connected to the solder pad.

Figure 3:
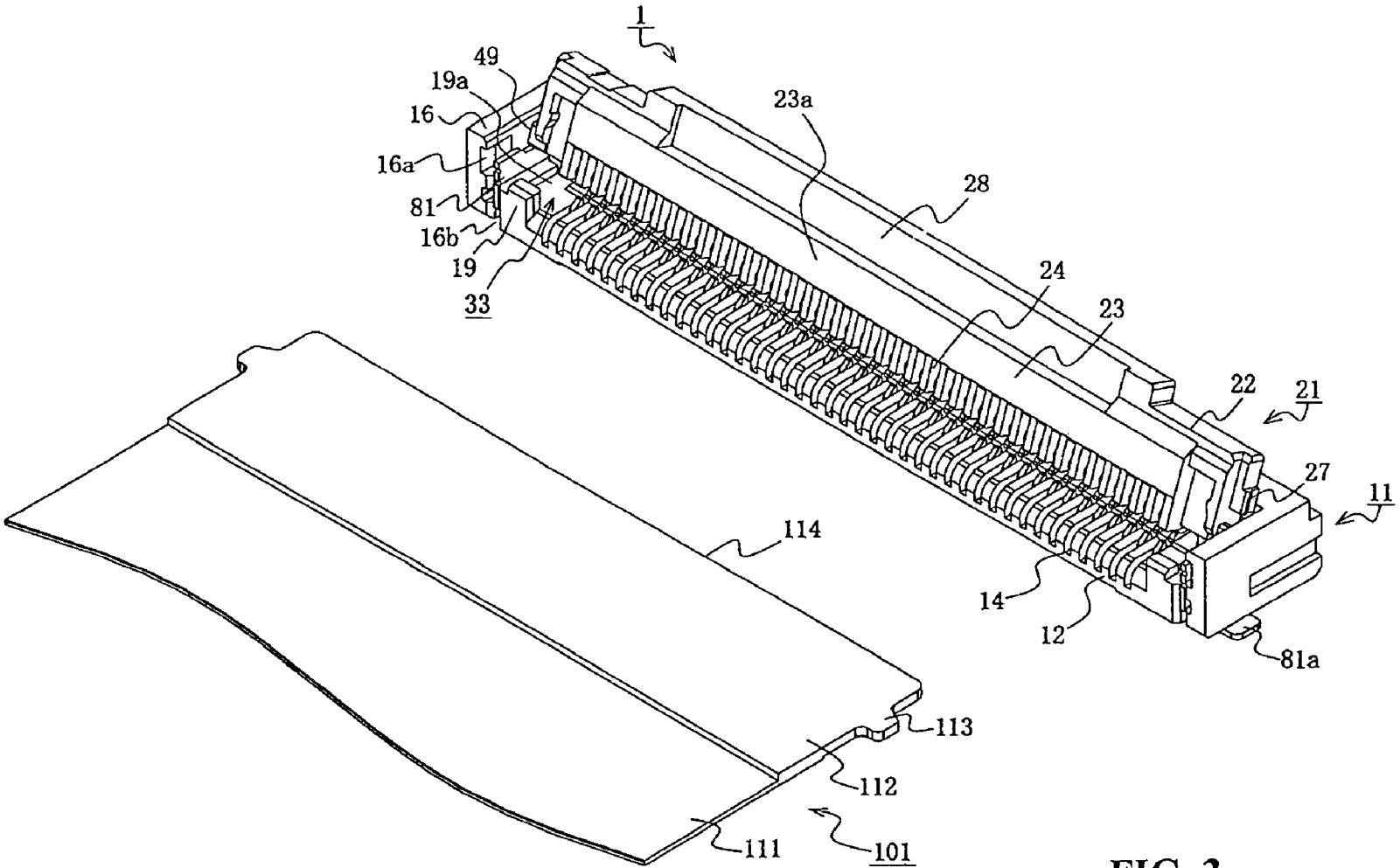
FIG. 3 is a perspective view of the cable connector of FIG. 1 illustrating the actuator at its open position and a flat flexible cable positioned prior to insertion into the connector.

In operation, as shown in FIGS. 3 and 7, the actuator 21 is at its first or open position at which the flat flexible cable 101 may be inserted into the insertion opening 33 of the housing 11. An operator inserts the front end portion 114 of the flat flexible cable 101 into the insertion opening 33 of the housing 11 with the contact pads 151 facing downward. It is desirable that the cable 101 be inclined upward as it is inserted in order to permit ear portions 113 of the flat flexible cable 101 to pass over cable engaging portions 19 and into the cable engaging recesses 19*a*. During insertion, the front end portion 114 of the flat flexible cable 101 is first brought into abutting contact with the upper surface 12*a* of the lower portion 12 of the housing 11 and subsequently moved along the upper surface 12*a* toward the rear side of the housing 11.

The front end portion 114 of the flat flexible cable 101 subsequently contacts the front terminal sloped surface 53*b* formed at the front side of the front contact portion 53*a* projecting upward from the upper surface 12*a* of the lower portion 12. Since the front terminal sloped surface 53*b* is inclined upward toward the rear side and the distance the front contact portion 53*a* projects above upper surface 12*a* of lower portion 12 is small, the front end portion 114 of the flat flexible cable 101 will rise smoothly over the front terminal sloped surface 53*b*. In addition, since the front contact beam 53 deflects in a spring-like manner thus displacing front contact portion 53*a* downward, the amount the front end portion 114 of the flat flexible cable 101 must rise is decreased so that the front end portion 114 of the flat flexible cable 101 further rises smoothly.

After passing the front contact portion 53*a*, the front end portion 114 of the 2 0 flat flexible cable 101 contacts the rear terminal sloped surface 54*b* formed at the front side of the rear contact portion 54*a* that projects above upper surface 12*a* of the lower portion 12. Since the rear terminal sloped surface 54*b* is inclined upward towards the rear side, the front end portion 114 of the flat flexible cable 101 rises smoothly along the rear terminal sloped surface 54*b*. Although the distance the rear contact portion 54*a* projects above upper surface 12*a* is greater than the distance front contact portion 53*a* projects above upper surface 12*a*, the increase is not significant because front end portion 114 of the flat flexible cable 101 is already raised to some extent after passing the front contact portion 53*a*. Therefore, the front end portion 114 of the flat flexible cable 101 still rises smoothly as it passes over rear contact beam 54. Since the rear contact beam 54 is deflected in a spring-like manner thus displacing the rear contact portion 54*a* downward, the amount the front end portion 114 of the flat flexible cable 101 must be raised becomes smaller so that the front end portion 114 of the flat flexible cable 101 is raised more smoothly.

After passing the front contact portion 53*a* and the rear contact portion 54*a*, the front end portion 114 of the flat flexible cable 101 is moved rearward or further into the housing 11 while being directed slightly obliquely upward and brought into abutting contact with the front end surface 13*a* of the terminal supporting portion 13 in order to correctly position the cable 101 within the housing.

Figure 4:
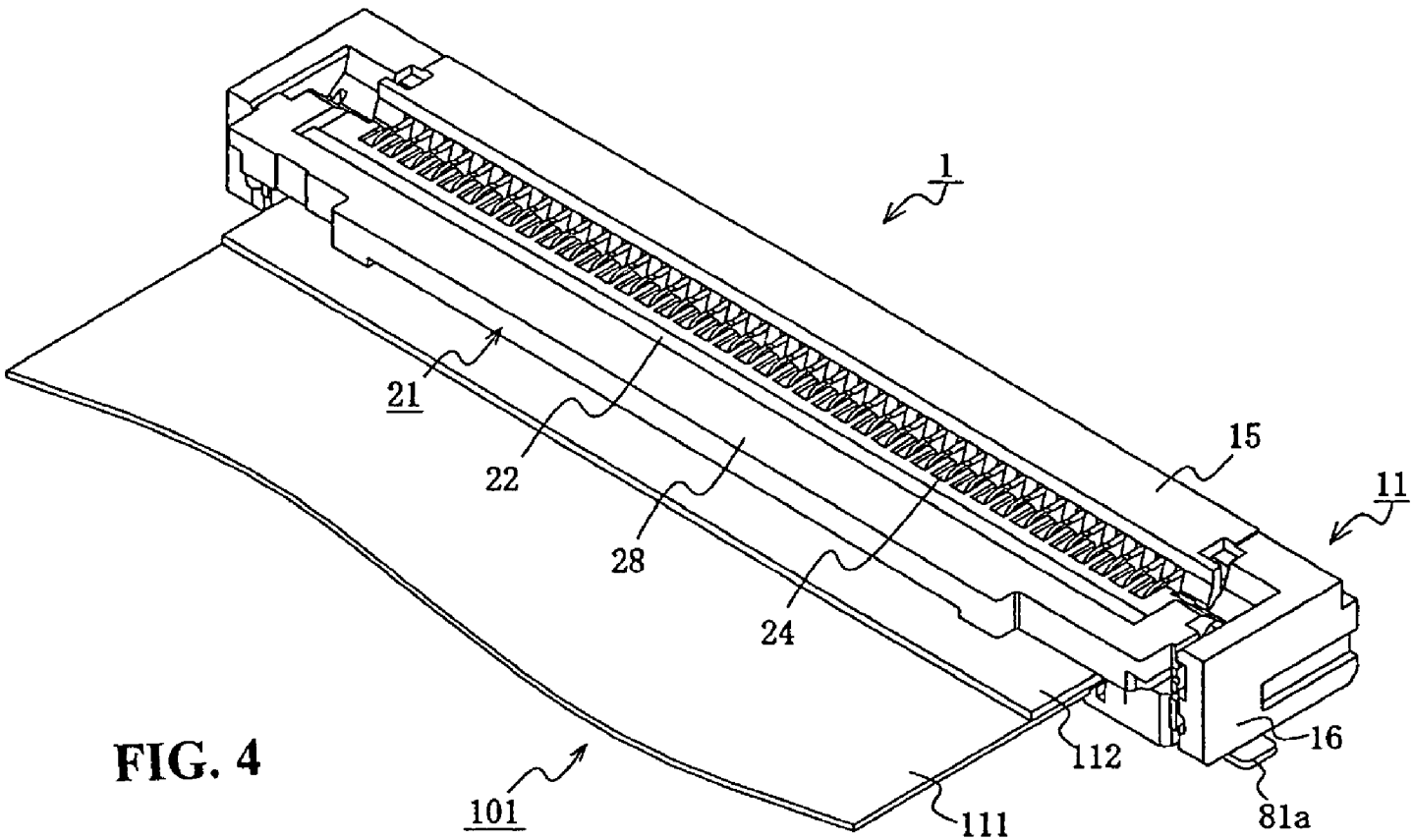
FIG. 4 is a perspective view of the cable connector of FIG. 1, illustrating a flat flexible cable connected to the cable connector.

The operator then engages the operating portion 28 of the actuator 21 with his or her finger or the like to rotate the actuator 21 from the open position to the closed position. In doing so, the front end of the actuator body 22 is lowered, and as shown in FIG. 4, the locking portions 27 of the actuator 21 are brought into engagement with the engaging recesses 16*a* formed in the inner surfaces of the side portions 16 of the housing 11 to lock the actuator 21 in the closed position.

As shown in FIG. 8, the pressing surface 23*a* of the pressing portion 23 contacts the upper surface of the flat flexible cable 101 on the surface opposite the contact pads 151 and along the auxiliary plate 112, thereby pressing the flat flexible cable 101 downward. As a result, each contact pad 151 is forced into contact with an aligned front contact portion 53*a* of a front contact beam 53 and the rear contact portion 54*a* of an aligned rear contact beam 54 of a single terminal 51. With this arrangement, the respective contact pads 151 are electrically connected to the corresponding terminals 51 and are also electrically connected to appropriate conductive traces of the board via the solder pad connected to the tail portions 58 of the terminals 51.

Through this configuration, each front contact portion 53*a* and its rear contact portion 54*a* are pressed in a mutually independent manner against a respective contact pad 151 of the flat flexible cable 101 and it is therefore possible to maintain secure contact between the front and rear contact portions and the contact pads 151 even if debris becomes lodged between one of the front contact portion 53*a* or the rear contact portion 54*a* and the contact pad 151. In addition, the flat flexible cable 101 is secured between the pressing portion 23 of the actuator 21 and the front contact portion 53*a* and the rear contact portion 54*a* by the downward force of the pressing portion 23 of the actuator 21 and the upward force of the front contact portion 53*a* and the rear contact portion 54*a*; therefore, the flat flexible cable 101 is securely retained within the insertion opening 33.

Since the connection of the flat flexible cable 101 to the connector 1 is not necessarily performed in a clean environment such as a clean room, the connection is sometimes performed in a state where foreign material such as dust or other unwanted debris floating in the air adheres to the contact pads 151 of the flat flexible cable 101. If such foreign material becomes lodged between the contact pad 151 and one of the contact portions, i.e., the front contact portion 53*a* or the rear contact portion 54*a*, and as a result, the contact pad 151 is not electrically connected to the front contact portion 53*a* or the rear contact portion 54*a*, the electrical connection between the contact pad 151 and the respective terminal 51 may still be maintained due to the contact between the other contact portions, i.e., the rear contact portion 54*a* or the front contact portion 53*a*, and the contact pad 151. Even if the foreign material is large and the amount of downward displacement of the front contact portion 53*a* or the rear contact portion 54*a* is likewise large, since the front contact beam 53 and the rear contact beam 54 are independent from each other, the other contact portion, i.e., the rear contact portion 54*a* or the rear contact portion 53*a*, is not displaced downward in an associated manner. Thus, the electrical connection to the contact pad 151 is maintained.

In operation, when the flat flexible cable 101 is inserted into the insertion opening 33, the contact pad 151 is first brought into contact with the front contact portion 53*a* and then with the rear contact portion 54*a*. Therefore, foreign material adhering to the contact pad 151 is more likely to become lodged between the contact pad 151 and the front contact portion 53*a*. In such a case, since the front contact portion 53*a* and the rear contact portion 54*a* are separated from each other in the cable insertion direction by a predetermined relatively large gap, the foreign material may fall into the gap between the front contact portion 53*a* and the rear contact portion 54*a* of the terminal rather than engaging the rear contact portions 54*a*. This is a further aspect of the present design that increases the reliability of the terminal 51 and contact pad 151 interface.

The present invention is not limited to the above-described embodiments, and may be changed in various ways based on the gist of the present invention, and these changes are not eliminated from the scope of the present invention. For example, although the number of contact arm portions has been described as two, the number of contact arm portions may be three or more.

What is claimed is:

1. A cable connector, comprising:

an insulative housing, the housing including an insertion opening through which a flat flexible cable may be inserted;

an actuator, the actuator being movably mounted on the housing and configured to be moved from a first position, at which the flat flexible cable may be inserted, and a second position, at which contact pads of the flat flexible cable are operatively engaged by terminals of the connector; and a plurality of conductive terminals, each terminal being mounted in the housing and configured to be electrically connected to a contact pad of the flat flexible cable, each terminal including a base portion, the base portion disposed at a rear end of the terminal and extending in the vertical direction, an actuator holding arm portion, which engages the actuator to facilitate movement of the actuator between the first and second positions, a front resilient contact arm portion, and a rear resilient contact arm portion, the contact arm portions engage the contact pads in a mutually independent way to maintain secure contact between the contact arm portions and the contact pads;

wherein:

the actuator holding arm portion and each contact arm portion have a proximal end thereof secured to the base portion and a contact portion at a free end of thereof configured to engage the contact pads; and the first contact arm portion is secured to the base portion below the second contact arm portion.

2. The cable connector according to claim 1, wherein the actuator is rotatably mounted on the housing for rotational movement between the first and second positions.

3. The cable connector according to claim 2, wherein the actuator holding arm portion engages a shaft portion of the actuator to facilitate the rotation of the actuator.

4. The cable connector according to claim 3, wherein the actuator includes a cable pressing surface, the cable pressing surface being opposed to the contact arm portions when the actuator is in the second position.

5. The cable connector according to claim 4, wherein the contact arm portions are disposed at mutually different positions with respect to an insertion direction of the flat flexible cable.

6. The cable connector according to claim 1, wherein the contact arm portions are disposed at mutually different positions with respect to an insertion direction of the flat flexible cable.

7. The cable connector according to claim 1, wherein the actuator includes a cable pressing surface, the cable pressing surface being opposed to the contact arm portions when the actuator is in the second position.

8. The cable connector according to claim 1, wherein each terminal includes both the actuator holding arm portion for engaging the actuator and the plurality of distinct, resilient, cantilevered, contact arm portions configured to be electrically connected to one of the contact pads.

* * * * *